US005990777A

United States Patent [19]

Whiteman, Jr.

[11] Patent Number: 5,990,777

[45] Date of Patent: Nov. 23, 1999

[54] SHAPE-MEMORY WIRE ACTUATED SWITCH

[75] Inventor: Robert Neil Whiteman, Jr., Middletown, Pa.

[73] Assignee: The Whitaker Corporation, Wilmington, Del.

[21] Appl. No.: 09/129,618

[22] Filed: Aug. 5, 1998

[51] Int. Cl.[6] ..... H01H 61/06; H01H 37/46; H01H 37/50

[52] U.S. Cl. ..... 337/140; 337/12; 337/343; 337/393; 60/527; 60/528

[58] Field of Search ..... 337/333, 121, 337/140, 339, 141, 343, 393; 439/161, 267, 325, 630, 932; 148/402, 563; 60/527, 528

[56] References Cited

U.S. PATENT DOCUMENTS

| | | | |
|---|---|---|---|
| 3,634,803 | 1/1972 | Willson | 337/123 |
| 3,748,197 | 7/1973 | Willson et al. | 148/131 |
| 3,872,415 | 3/1975 | Clarke | 337/140 |
| 3,893,055 | 7/1975 | Jost et al. | 337/140 |
| 3,967,227 | 6/1976 | Clarke et al. | 337/124 |
| 5,061,914 | 10/1991 | Busch et al. | 337/140 |
| 5,083,439 | 1/1992 | Orner et al. | 62/187 |
| 5,144,813 | 9/1992 | Orner et al. | 62/187 |
| 5,420,561 | 5/1995 | Swensen | 337/365 |
| 5,455,549 | 10/1995 | Strickland et al. | 335/17 |
| 5,462,451 | 10/1995 | Yeh | 439/493 |
| 5,511,519 | 4/1996 | Watson et al. | 123/179.18 |
| 5,564,936 | 10/1996 | David et al. | 439/159 |
| 5,573,413 | 11/1996 | David et al. | 439/159 |
| 5,597,316 | 1/1997 | David et al. | 439/159 |
| 5,618,269 | 4/1997 | Jacobsen et al. | 604/118 |
| 5,619,177 | 4/1997 | Johnson et al. | 337/140 |
| 5,629,662 | 5/1997 | Floyd et al. | 337/36 |
| 5,831,820 | 11/1998 | Huang | 361/686 |

*Primary Examiner*—Leo P. Picard
*Assistant Examiner*—Anatoly Vortman
*Attorney, Agent, or Firm*—Anton P. Ness; Bradley N. Ditty

[57] ABSTRACT

A switch (10) is provided that has a housing (12), an actuator (20), a contact blade (18), first and second shape-memory wires (28,30), and first and second contact points (70,71). The actuator (20) has a first end portion (52) pivotally coupled to the housing (12), and a second end portion (22) with first and second generally opposed arm portions (24), (26) extending therefrom. The contact blade (18) has the first contact point (70) positioned thereon, and is coupled to and moveable with the actuator (20). The first and second shape-memory wires (28,30) respectively extend between the first and second arm portions (24,26) of the actuator (20) and the housing (12). The second contact point (71) is coupled to the housing (12) and is electrically engageable with the first contact point (70) in response to movement of the actuator (20).

27 Claims, 5 Drawing Sheets

10
81
19
70
71
74
68
72
64
15
62
82
20
30
28
38
90
36
16

SHAPE-MEMORY WIRE ACTUATED SWITCH

BACKGROUND OF THE INVENTION

1. Field of the Invention

This invention relates generally to electrical switches, relays, and the like and, more particularly, to an electrical switch actuated by a shape-memory wire.

2. Description of the Related Art

Electrical switches and relays are now widely used in nearly all industries, and consequently, are produced in enormous quantities. Their wide use has made reliable operation and long life important factors in their design. Switches and relays have tended to be complex in mechanical design. Complex mechanical design, however, commonly results in devices that are difficult to assemble, and are prone to shortened life spans and unreliable operation.

Moreover, because so many switches and relays are manufactured, even a relatively modest cost savings per unit can still amount to substantial savings, when the switch is produced in mass quantities. Complex mechanical designs tend to be expensive because of the manufacturing requirements for the various parts and because of the difficulty commonly associated with their assembly.

The present invention is directed to overcoming, or at least reducing the effects of, one or more of the problems set forth above.

SUMMARY OF THE INVENTION

In one aspect of the present invention, a switch is provided. The switch includes a housing, an actuator, a contact blade, a shape-memory wire, and a first contact point and a second contact point. The actuator has a first end portion and a second end portion, and the first end portion is pivotally coupled to the housing. The contact blade has a first contact point positioned thereon, and is coupled to and generally moveable with the actuator. The shape-memory wire extends between and is secured to the actuator and the housing. The second contact point is coupled to the housing and is electrically engageable with the first contact point in response to movement of the actuator.

In another aspect of the present invention, an actuator assembly is provided. The actuator assembly includes an actuator and a shape-memory wire. The actuator has a first end portion and a second end portion and an arm portion extending from the second end portion. The actuator is engageable with a contact blade. The shape-memory wire extends from and is secured to the arm portion of the actuator.

BRIEF DESCRIPTION OF THE DRAWINGS

The invention may be understood by reference to the following description taken in conjunction with the accompanying drawings, in which like reference numerals identify like elements, and in which.

Figure 1:
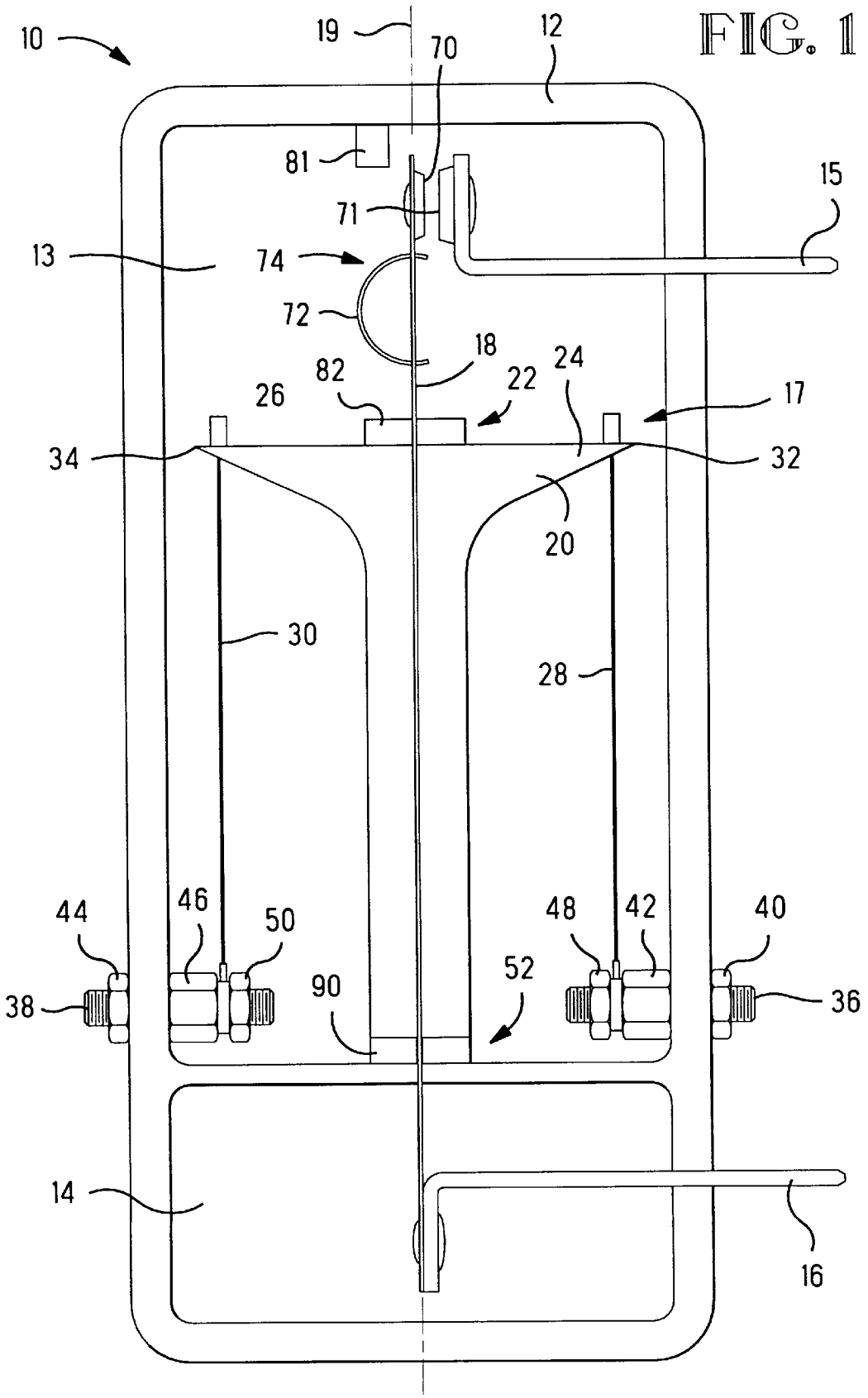
FIG. 1 illustrates a top view of an embodiment of a switch of the present invention in a first operating position.

While the invention is susceptible to various modifications and alternative forms, specific embodiments have been shown by way of example in the drawings and are described in detail. It should be understood, however, that the description herein of specific embodiments is not intended to limit the invention to the particular forms disclosed. On the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Moreover, while the embodiments described herein are directed to a switch 10, it is envisioned that the invention could be embodied in a relay without departing from the spirit and scope of the invention.

Turning now to the drawings, and in particular, to FIG. 1, a top view of a switch 10 is shown. The switch 10 includes a housing 12 that may be formed from any of a variety of materials, including plastics and metals. In the event that a metal housing is used, suitable insulators should be employed to properly isolate the housing 12 from the various electrical components therein. The housing 12 is divided into a first and second chamber 13, 14. A first electrical terminal 15 is associated with the first chamber 13, and a second electrical terminal 16 is associated with the second chamber 14. The first and second terminals 15, 16 are electrically connectable by the operation of an actuator assembly 17. A contact blade 18 is connected to and generally moveable with the actuator assembly 17. Thus, electrical power supplied to the second terminal 16 is supplied to the electrical terminal 15 when the contact blade 18 makes an electrical connection there-between. The actuator assembly 17 is shown in a centered position, with the contact blade 18 substantially aligned along a longitudinal axis 19. In practice, the actuator assembly 17 will not come to rest in this centered position, but rather, the actuator assembly 17 is listable and will tend to move to one of the two positions illustrated in FIGS. 3 and 4.

A T-shaped actuator 20 is positioned about the contact blade 18, engaging the contact blade 18—to a blade-coupling section—at a second end portion 22, while first end portion 52 is a housing-coupling section for pivotally coupling the actuator to the housing. Transverse arm portions 24, 26 of the actuator 20 engage shape-memory wires 28, 30 adjacent their distal end portions 32, 34. The wires 28, 30 extend longitudinally along the housing 12, and in the illustrated embodiment are generally parallel to the contact blade 18. The wires 28, 30 engage pins 36, 38 that extend through the housing 12. The pins 36, 38 are captured fixedly against the housing by fasteners 40, 42; 44, 46, such as threaded nuts. The wires 28, 30 may be mechanically and electrically coupled to the pins 36, 38 by fasteners 48, 50, such as threaded nuts.

The shape-memory wires 28, 30 may be formed from any of a variety of materials that change shape in response to a change in temperature. For example, a nickel-titanium wire, such as Flexinol® shortens, or returns to an original unstretched length, in response to heating, such as by passing an electrical current through it. In the illustrated embodiment, the wires 28, 30 may be separately energized by an electric current to selectively reduce their length. Shortening the length of the wire 28 causes the T-shaped actuator 20 to pivot about its first end portion 52, pivoting in a direction toward the wire 28. The pivoting motion of the actuator 20 also stretches the wire 30 in preparation of its later operation. That is, a subsequent heating and shortening of the length of the wire 30 causes the T-shaped actuator 20 to pivot in a direction toward the wire 30. Since the contact blade 18 is coupled to the actuator 20 at its second end portion 22, pivoting of the actuator 20 produces a corresponding movement of the contact blade 18. Pivotal movement of the actuator 20 pulls at least a portion of the contact blade 18 away from the longitudinal axis 19.

It should be appreciated that in an alternative embodiment, the second chamber 14 may be eliminated from the housing 12. In this alternative embodiment, the contact blade 18 extends through the housing 12, and may be used in lieu of the electrical terminal 16. That is, electrical power may be connected directly to the contact blade 18 instead of through an additional terminal, such as the electrical terminal 16. Alternatively, the second chamber 14 could be replaced with a mirror image of the elements in the first chamber 13 to produce a two-pole switch.

Figure 2:
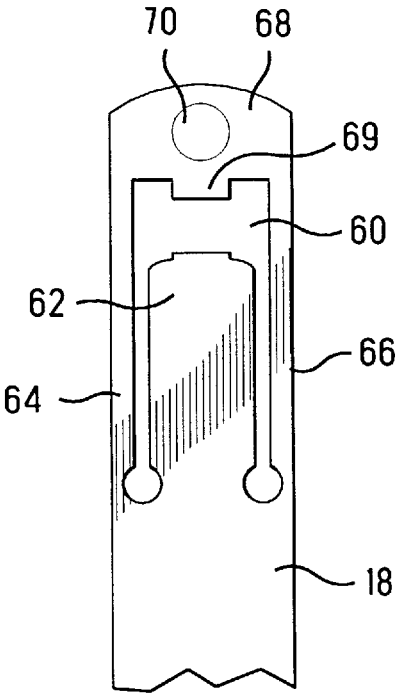
FIG. 2 illustrates a side view of one embodiment of a contact blade of the switch of FIG. 1.
Figure 5:
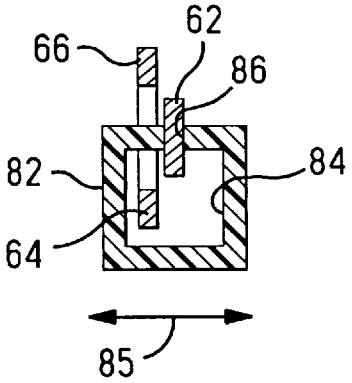
FIG. 5 illustrates a cross-sectional view of one embodiment of a first clamping mechanism of the switch of FIG. 1.

Turning now to FIG. 2, a side view of one embodiment of the contact blade 18 of the switch 10 of FIG. 1 is shown. The contact blade 18 has a generally U-shaped opening 60 formed therein. The U-shaped opening 60 divides the contact blade 18 into three general regions, a center tang 62 and two outer tangs 64, 66. The outer tangs 64, 66 are coupled together in a region 68 where a contact point 70 is formed. A mating contact point 71 is located on the electrical terminal 15 (see FIG. 1). In the illustrated embodiment, the contact blade 18 is formed of an electrically conductive material, such as beryllium copper. The outer tangs 64, 66 and the region 68 are coupled to the center tang 62 by a U-shaped spring 72 (see FIG. 1) engaged with a pair of tabs 69. As more fully described below in conjunction with FIGS. 3 and 4, the U-shaped spring 72 interacts with the tangs 62, 64, 66 and the region 68 of the contact blade 18 to form an over-center, snap-action assembly 74.

Figure 3:
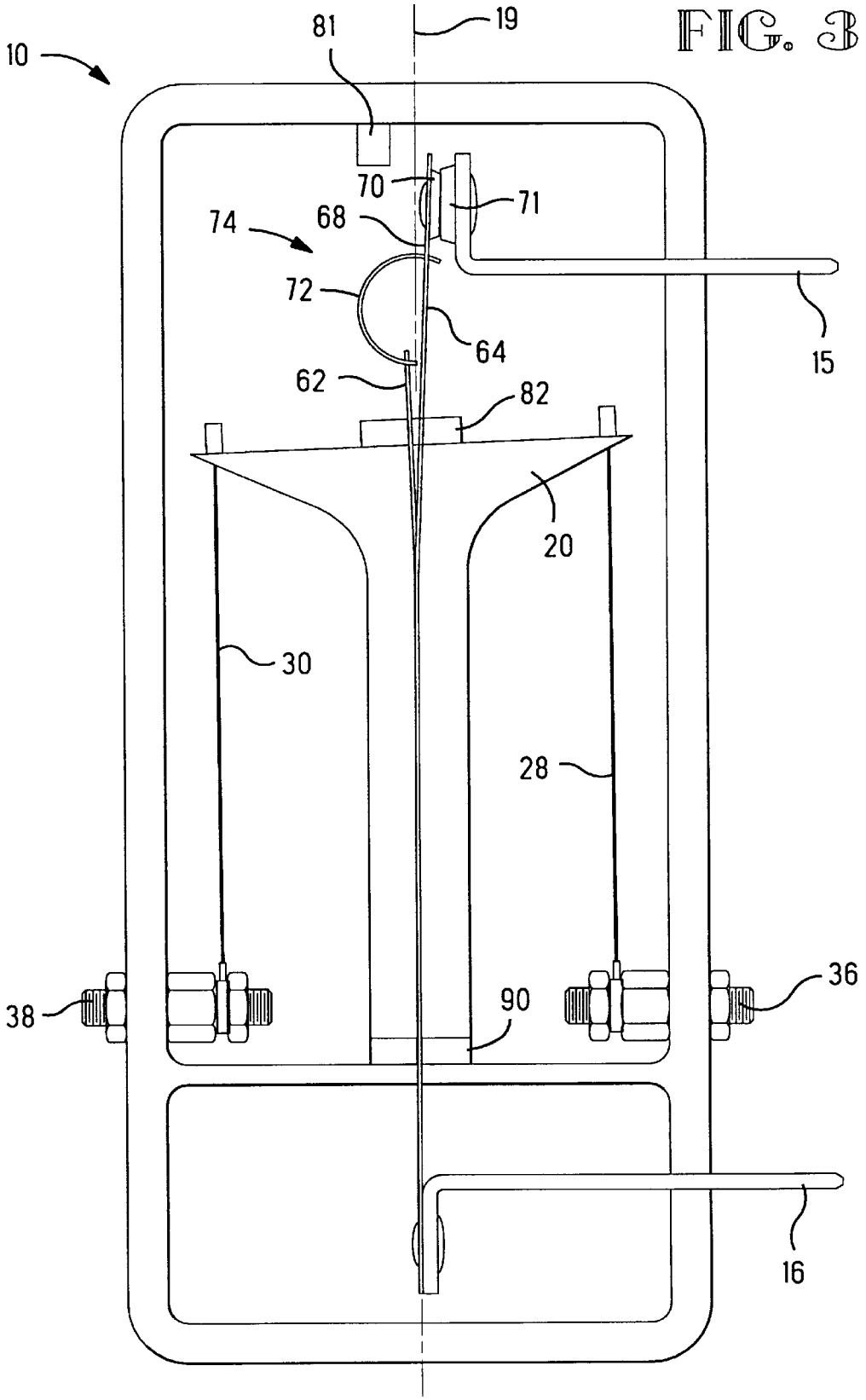
FIG. 3 illustrates a top view of the switch of FIG. 1 in a second operating position.

Referring now to FIG. 3, the switch 10 is shown in a first actuated position, with the contact blade 18 electrically engaged with the second terminal 15. In the illustrated embodiment, the shape-memory wire 30 has been heated, such as by passing electrical current through it. The wire 30 has responded to the heat by returning to its original, shorter length. The shortened wire 30 causes the T-shaped actuator 20 to pivot toward the wire 30, pulling the center tang 62 of the contact blade 18 away from the longitudinal axis 19. Pivoting movement of the T-shaped actuator 20 also stretches the opposite wire 28. Thus, when the wire 28 is subsequently heated, it will return to its shortened length, and urge the actuator 20 toward the wire 28, as shown and discussed with respect to FIG. 4.

The region 68, however, does not move with the T-shaped actuator 20, but remains unmoved on the longitudinal axis 19. Because the center tang 62 and region 68 are no longer aligned with the direction of force exerted by the U-shaped spring 72, the U-shaped spring 72 biases the region 68 away from the inner tang 62. Thus, the region 68 is displaced away from the longitudinal axis 19 in a direction opposite to that of the inner tang 62. Movement of the region 68 is relatively fast, and occurs in response to the center tang 62 being moved past alignment with the region 68 and outer tangs 64, 66.

Figure 4:
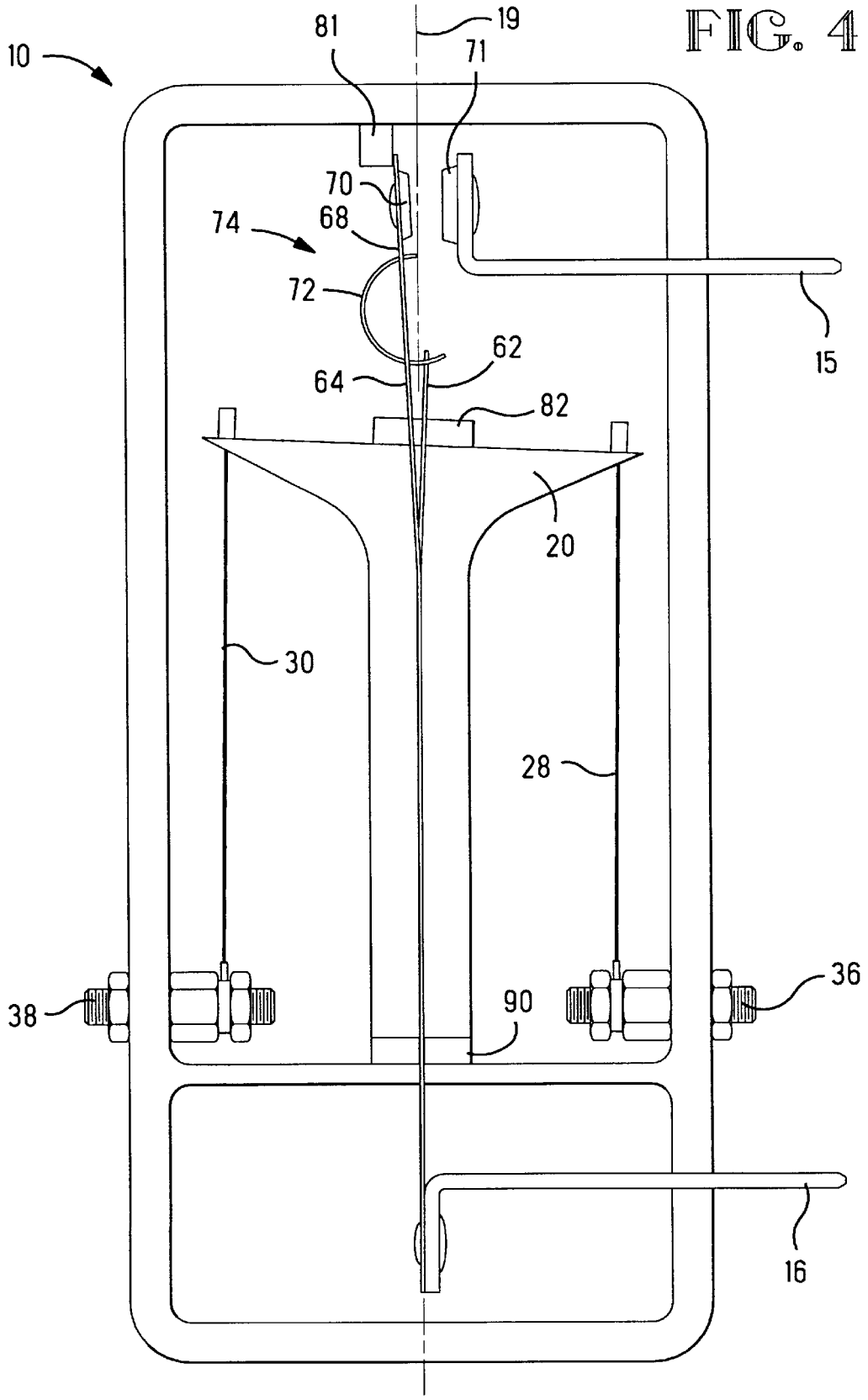
FIG. 4 illustrates a top view of the switch of FIG. 1 in a third operating position.

Referring now to FIG. 4, the switch 10 is shown in an "off" position, with the contact blade 18 electrically disengaged from the second terminal 15 and engaged with a mechanical stop 81 to prevent over-travel. In the illustrated embodiment, the shape-memory wire 28 has been heated, such as by passing electrical current through it. The wire 28 has responded to the heat by returning to its original, shorter length. The shortened wire 28 causes the T-shaped actuator 20 to pivot toward the wire 28, pulling the center tang 62 of the contact blade 18 past alignment with the region 68 and outer tangs 64, 66. The region 68, however, does not move with the T-shaped actuator 20, but remains unmoved. Because the center tang 62 and region 68 are no longer aligned with the direction of force exerted by the U-shaped spring 72, the U-shaped spring 72 biases the region 68 away from the inner tang 62. Thus, the region 68 is displaced away from the longitudinal axis 19 in a direction opposite to that of the inner tang 62. Movement of the region 68 is relatively fast, and occurs in response to the center tang 62 being moved past alignment with the region 68.

Electrical power is supplied to the shape-memory wires 28, 30 via an electrical path that includes the electrical terminal 16, the contact blade 18, the T-shaped actuator 20, and the pins 36, 38. In one embodiment, the electrical terminal 16 is coupled to a first terminal of a power supply (not shown) and the terminals 36, 38 are controllably connectable to a second terminal of the power supply (not shown) by, for example, a control system (not shown). The T-shaped actuator 20 is formed from an electrically conductive material, or at least includes an electrically conductive portion between the contact blade 18 and the wires 28, 30. Thus, when, for example, it is desired that the terminal 15 be disconnected from the contact blade 18 (such as is shown in FIG. 4), the pin 36 is controllably coupled to the first terminal of the power supply (not shown). Current flows from the second terminal of the power supply (not shown) through the terminal 16, the contact blade 18, the T-shaped actuator 20, the shape-memory wire 28, and the pin 36 to the second terminal of the power supply (not shown).

Similarly, when it is desired that the terminal 15 be connected with the contact blade 18 (such as is shown in FIG. 3), the pin 38 is controllably coupled to the first terminal of the power supply (not shown). Current flows from the second terminal of the power supply (not shown) through the terminal 16, the contact blade 18, the T-shaped actuator 20, the shape-memory wire 30, and the pin 38 to the second terminal of the power supply (not shown).

Alternative embodiments are envisioned in which the terminal of the power supply is not connected through the contact blade 18, but through an additional electrical connector (not shown) mounted on the housing 12 and electrically connected to the shape-memory wires 28, 30.

As shown in FIGS. 1, 3 and 4, the contact blade 18 is mechanically coupled to the T-shaped actuator 20 by a cap 82. A top cross-sectional view of the cap 82 is shown in FIG.

5. The cap 82 is integrally formed with or coupled to the T-shaped actuator 20 and engages the center tang 62 of the contact blade 18 in a narrow opening 86 (see FIG. 8), but allows the outer tangs 64, 66 to remain free for relative movement orthogonally with respect to center tang 62. That is, the cap 82 includes a central opening 84 through which at least one of the outer tangs 64, 66 extends after the contact blade is inserted edgewise into the narrow opening 86. The size of the opening 84 is sufficient to accommodate movement of the outer tang 64, 66 throughout the expected range of motion. Thus, movement of the T-shaped actuator 20 in a direction indicated by an arrow 85, causes the center tang 62 to move in the same direction, but allows the outer tangs 64, 66 to remain unmoved, such as is shown in FIGS. 3 and 4.

Electrical power may be provided from the contact blade 18 to the wires 28, 30 through the cap 82 by constructing it of a conductive material, such as a metal. Alternatively, the cap 82 may be constructed of a non-conductive material, such as plastic, and electrical wires may be coupled between the shape-memory wires 28, 30 and the contact blade 18.

Figure 6:
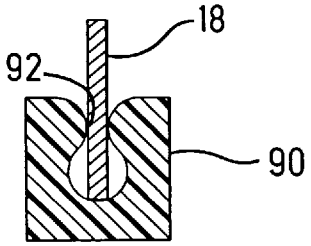
FIG. 6 illustrates a cross-sectional view of one embodiment of a boss of the switch of FIG. 1.

Referring now to FIGS. 1 and 6, a boss 90 is coupled to the contact blade 18 adjacent the first end portion 52 of the T-shaped actuator 20, defining a blade-coupling section. The boss 90, as shown in FIG. 6, is of a generally square configuration with a central opening 92 adapted to receive the contact blade 18. The opening 92 has a dimension slightly less than the thickness of the contact blade 18 so that a frictional fit exists between the contact blade 18 and the boss 90. It is envisioned that other methods of coupling the boss 90 to the contact blade 18 may be employed without departing from the spirit and scope of the invention, such as gluing, soldering, welding, or integral formation therewith. The boss 90 may be constructed of a plastic material or a conductive material to provide an alternate electric path between the contact blade 18 and the wires 28, 30.

Figure 8:
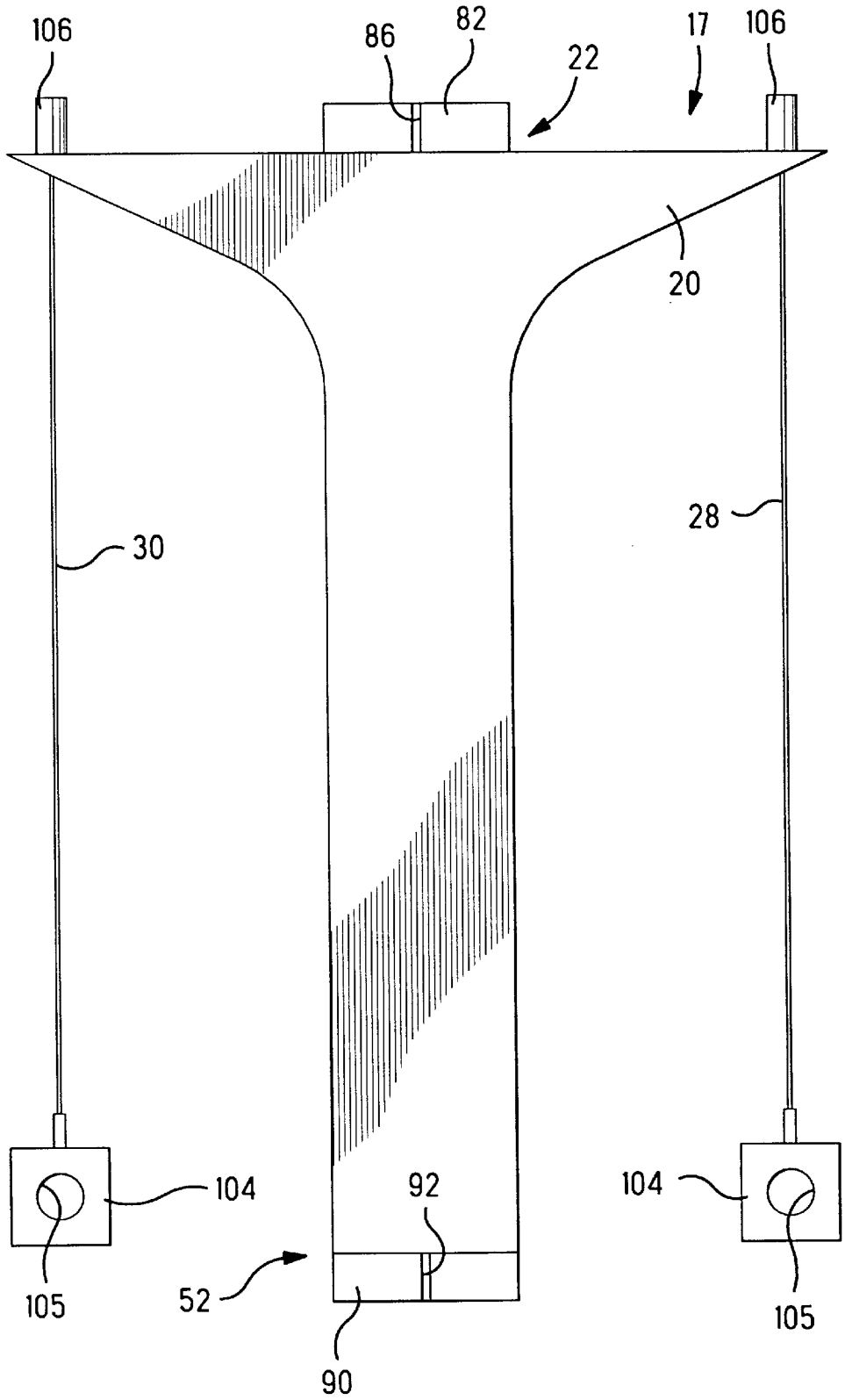
FIG. 8 illustrates a top view of an actuator assembly of FIGS. 1, 3, and 4.

The function of the boss 90 is to restrict movement of the T-shaped actuator 20 into the second chamber 14. It is envisioned that actuator assembly 17, as shown in FIG. 8, includes the T-shaped actuator 20, cap 82, boss 90, and shape-memory wires 28, 30 assembled as a unit, which is then placed into the housing 12. The only additional assembly needed thereafter would be to couple the shape-memory wires 28, 30 to their respective pins 36, 38, and to insert the pre-assembled contact blade 18 and U-shaped spring 72 into the actuator assembly 17.

Figure 7:
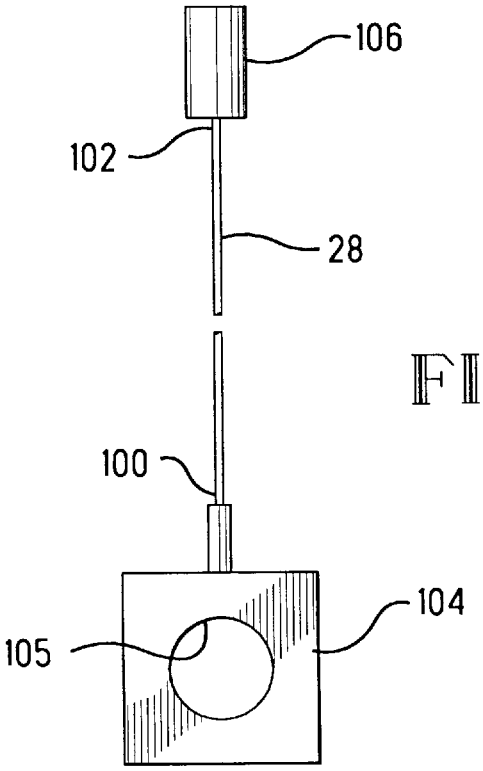
FIG. 7 illustrates a top view of a memory shape wire of the switch of FIG. 1.

Assembly of the shape-memory wires 28, 30 onto their respective pins 36, 38 is facilitated by their configuration. As shown in FIG. 7, the shape-memory wire 28 has a first end portion 100 and a second end portion 102. The first end portion 100 is coupled to a conventional fitting 104, such as a ring terminal or other standard fitting, via crimping, soldering, welding, or the like. The fitting 104 has a bore 105 formed therein sufficient in size to accept the pin 36 therethrough. The second end portion 102 is coupled to a cylindrical fitting 106 via crimping, soldering, welding, or the like. The wire 28 passes through a bore or slot (not shown) in the arm portion 24 of the T-shaped actuator 20. The cylindrical fitting 106 is sufficient in size to resist being pulled through the bore or slot in the arm portion 24. Thus, as the wire 28 is heated, it shrinks in length and pulls the arm portion 24 of the actuator 20 toward the pin 36, pivoting the T-shaped actuator 20 as shown in FIG. 4. It is envisioned that the cylindrical fitting 106 may be integrally formed with the T-shaped actuator 20 to facilitate assembly of the actuator assembly 17.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. An apparatus, comprising:

a housing;

an actuator having a first end portion and a second end portion, the first end portion being coupled to said housing, and the second end portion having a transverse arm portion whereby the actuator is T-shaped;

a separate contact blade having a first contact point positioned on a first blade portion thereof, the contact blade being coupled at a second blade portion to said actuator that is moveable with said actuator, said first and second blade portions of said contact blade being moveable with respect to each other;

a shape-memory wire extending between and secured to said second end portion of said actuator and said housing; and a second contact point coupled to said housing and being electrically engageable with the first contact point in response to movement of said actuator.

2. An apparatus, as set forth in claim 1, wherein said actuator includes an arm portion extending therefrom to which shape-memory wire is attached.

3. An apparatus, as set forth in claim 1, wherein said actuator includes first and second generally opposed arm portions extending therefrom, and said shape-memory wire includes first and second shaped-memory wires respectively extending between said first and second arm portions and said housing.

4. An apparatus, as set forth in claim 3, wherein said contact blade is electrically coupled to said first and second shape-memory wires.

5. An apparatus, as set forth in claim 1, wherein said apparatus is a switch.

6. An apparatus, as set forth in claim 1, wherein said apparatus is a relay.

7. An apparatus, as set forth in claim 1 wherein said actuator and said shape-memory wire define a subassembly adapted to be mounted into said housing and coupleable to said housing and to said contact blade.

8. An apparatus, as set forth in claim 7 wherein said actuator includes a boss mounted at said first end and having a narrow opening adapted to receive thereinto a portion of said contact blade.

9. An apparatus, as set forth in claim 7 wherein said actuator includes a cap mounted at said second end and having a narrow opening adapted to receive thereinto a portion of said contact blade edgewise.

10. An apparatus, as set forth in claim 9, wherein said cap couples to a center tang of said contact blade while permitting outer tangs spaced laterally from said center tang to move freely orthogonally with respect to said center tang during actuation.

11. An apparatus, as set forth in claim 10, wherein said cap includes a clearance opening receiving thereinto one of said outer tangs to extend through said cap in said clearance opening.

12. An actuator assembly, comprising:

a T-shaped actuator having a first end portion and a second end portion and a transverse arm portion extending from said second end portion, said actuator having a blade-coupling section for coupling to a separate contact blade mounted in a housing, and said first end portion having a housing-coupling section; and a shape-memory wire extending from the arm portion of said actuator to be coupled to said housing.

13. An actuator assembly, as set forth in claim 12, wherein said actuator includes first and second generally opposed arm portions extending therefrom, and said shape-memory wire includes first and second shaped-memory wires respectively extending from said first and second arm portions.

14. An actuator assembly, as set forth in claim 12, wherein said shape-memory wire is adapted to be electrically coupled to said contact blade.

15. An actuator assembly, as set forth in claim 12, wherein said actuator includes a boss mounted at said first end and having a narrow opening adapted to receive thereinto a portion of said contact blade edgewise.

16. An actuator assembly, as set forth in claim 12, wherein said actuator includes a cap mounted at said second end and having a narrow opening adapted to receive thereinto a portion of said contact blade edgewise.

17. An actuator assembly, as set forth in claim 16, wherein said cap couples to a center tang of said contact blade while permitting outer tangs spaced laterally from said center tang to move freely orthogonally with respect to said center tang during actuation.

18. An actuator assembly, as set forth in claim 17, wherein said cap includes a clearance opening receiving thereinto one of said outer tangs to extend through said cap in said clearance opening.

19. An apparatus, comprising:

a housing;

a T-shaped actuator having a first end portion and a second end portion, the first end portion being pivotally coupled to said housing, and said second end portion having first and second generally opposed arm portions extending therefrom;

a separate contact blade having a first contact point positioned on a first blade portion thereof, the contact blade being coupled at a second blade portion to said actuator that is moveable with said actuator, said first and second blade portions of said contact blade being moveable with respect to each other;

a first and second shape-memory wire respectively extending between and secured to said first and second arm portions of said actuator and said housing; and a second contact point coupled to said housing and being electrically engageable with the first contact point in response to movement of said actuator.

20. An apparatus, as set forth in claim 19, wherein said contact blade is electrically coupled to said first and second shape-memory wires.

21. An apparatus, as set forth in claim 19, wherein said apparatus is a switch.

22. An apparatus, as set forth in claim 19, wherein said apparatus is a relay.

23. An apparatus, as set forth in claim 19, wherein said actuator and said shape-memory wire define a subassembly adapted to be mounted into said housing and coupleable to said housing and to said contact blade.

24. An apparatus, as set forth in claim 23, wherein said actuator includes a boss mounted at said first end and having a narrow opening adapted to receive thereinto a portion of said contact blade edgewise.

25. An apparatus, as set forth in claim 23, wherein said actuator includes a cap mounted at said second end and having a narrow opening adapted to receive thereinto a portion of said contact blade edgewise.

26. An apparatus, as set forth in claim 25, wherein said cap couples to a center tang of said contact blade while permitting outer tangs spaced laterally from said center tang to move freely orthogonally with respect to said center tang during actuation.

27. An apparatus, as set forth in claim 26, wherein said cap includes a clearance opening receiving thereinto one of said outer tangs to extend through said cap in said clearance opening.

* * * * *